United States Patent [19]

Hoffman

[11] 4,019,801

[45] Apr. 26, 1977

[54] ELECTRICAL SPLICE

[75] Inventor: Ronald Clarence Hoffman, Williamstown, Pa.

[73] Assignee: AMP Incorporated, Harrisburg, Pa.

[22] Filed: Jan. 19, 1976

[21] Appl. No.: 650,219

[52] U.S. Cl. ..... 339/98

[51] Int. Cl.[2] ..... H01R 9/08

[58] Field of Search ..... 339/95, 97–99, 339/260

[56] References Cited

UNITED STATES PATENTS

| | | | |
|---|---|---|---|
| 2,680,145 | 6/1954 | Lanfear | 339/97 R |
| 2,828,353 | 3/1958 | Adams et al. | 339/95 R |
| 2,965,699 | 12/1960 | Bollmeier | 339/98 |
| 3,058,088 | 10/1962 | Miller | 339/97 C |
| 3,233,206 | 2/1966 | Fiala | 339/98 |
| 3,422,391 | 1/1969 | Thomson | 339/97 R |

*Primary Examiner*—Joseph H. McGlynn
*Attorney, Agent, or Firm*—Allan B. Osborne

[57] ABSTRACT

This invention relates to a device in which two wires can be spliced together. More particularly, the invention includes a stamped contact member folded around on itself whereby the two ends overlap, one end having a pair of wire-receiving openings and the other a pair of insulation-cutting, wire-receiving slots. The two wires are spliced together by moving one end past the other so that the slot edges make contact with the wire conductors. The contact member is housed in a resilient housing with a pair of closable passages in alignment with the openings in the contact member.

7 Claims, 5 Drawing Figures

ELECTRICAL SPLICE

BACKGROUND OF THE INVENTION

This invention is in the field of wire splicing. Further the invention provides means to protect the splice environmentally.

Wire splicing devices range from twisting the ends of two wires together to a more recent innovation utilizing wire-receiving slots wherein the edges of the slots cut through the insulation and make electrical contact with the underlying conductor. As the present invention uses wire-receiving slots only the prior art disclosing such splicing means will be discussed.

The earliest patent known to Applicant disclosing wire-receiving slots is U.S. Pat. No. 2,501,187 issued to Jan Oortgijsen. Subsequent patents include U.S. Pat. No. 3,012,219 and more recently U.S. Pat. No. 3,860,318, the latter advancing the art considerably by the successful termination of two wires in a single slot.

The slot designs have remained relatively unchanged so far as single wire termination is concerned. The blades; i.e., the slot-carrier, have changed in shape, positioning and in number. For example, compare the blade in the aforementioned U.S. Pat. No. 3,012,219 with the dual-in-line cantilever blades in U.S. Pat. No. 3,864,011.

The method of terminating a wire has generally remained the same; i.e., the edges of the slot cut through the insulation and make electrical contact with the underlying conductor. In some devices the wire is moved; in other the blades are moved; an example of the latter is disclosed in U.S. Pat. No. 3,920,305.

The method of supporting the blades has varied. For example, the blade disclosed in U.S. Pat. No. 3,012,219 is positioned in a deep groove cutting across the wire support surface. The blade disclosed in U.S. Pat. No. 3,836,944 is supported on its ends by vertical grooves in the insulating housing.

In addition to the patents noted above, other wire-in-slot patents include, but are not limited to, U.S. Pat. Nos. 3,388,370; 3,444,506; 3,874,764 and 3,912,356. In each of the noted patents and in other known but not listed patents which splice two or more wires together, one characteristic stands out. The wire-in-slot splice devices consist of one or more blades each having two slots and some means for retaining the wires in the slots. Generally the means is a cover or lid which closes down onto the blade-containing base to provide both an insulation and a wire-retaining means. In other words, all the known devices must include two elements; the blade and the wire-retaining means.

As is well known, bare electrical conductors connected to a terminal of some type or spliced together offer a point of least resistance to attack by corrosive agents in the environment. And, as is also well known, corrosion increases the resistance and ultimately destroys the connection or splice.

Solutions to preventing corrosive attack include plastic waterproof tape, unctuous grease, heat shrinkable sleeves and tapes and housing surrounding the connection or splice which can be sealed. Obviously, the variety of solutions touched upon above represent solutions to particular problems. For example, the method of providing protection for a splice on the telephone cables underyling the streets of New York City require enclosing the splice area with a bulky resin-filled sleeve such as disclosed in U.S. Pat. No. 2,957,038. A method for protecting spliced electrical mining cable using a resilient sleeve is disclosed in U.S. Pat. No. 3,824,331.

With particular reference to wire splicing devices, one prior art device known to Applicant is a connector made and sold under the trademark SCHOTCHLOK by the Minnesota Mining and Manufacturing Company. This connector consists of a housing having a movable cap and two or more wire-in-slot contact blades in a cavity which is filled with a waterproof grease. After the wires are inserted into the cavity and on top of the contact blades, the cap is pushed down into the cavity to drive the wires into the slots to establish a common to provide both an insulation and a wire-retaining means. In other words, all the known devices must include two elements; the blade and the wire-retaining means.

As is well known, bare electrical conductors connected to a terminal of some type or spliced together offer a point of least resistance to attack by corrosive agents in the environment. And, as is also well known, corrosion increases the resistance and ultimately destroys the connection or splice.

Solutions to preventing corrosive attack include plastic waterproof tape, unctuous grease, heat shrinkable sleeves and tapes and housing surrounding the connection or splice which can be sealed. Obviously, the variety of solutions touched upon above represent solutions to particular problems. For example, the method of providing protection for a splice on the telephone cables underlying the streets of New York City require enclosing the splice area with a bulky resin-filled sleeve such as disclosed in U.S. Pat. No. 2,957,038. A method for protecting spliced electrical mining cable using a resilient sleeve is disclosed in U.S. Pat. No. 3,824,331.

With particular reference to the present invention, the single prior art device known to Applicant is a connector made and sold under the trademark SCOTCHLOK by the Minnesota Mining and Manufacturing Company. This connector consists of a housing having a movable cap and two or more wire-in-slot contact blades in a cavity which is filled with a waterproof grease. After the wires are inserted into the cavity and on top of the contact blades, the cap is pushed down into the cavity to drive the wires into the slots to establish a common electrical bond therebetween. The combined specifically designed housing and grease provides an environmentally protected splice.

SUMMARY OF THE PRESENT INVENTION

The present invention consists of three elements which combine to provide a positive environmentally sealed splice without the use of shrinkable sleeves, tape, grease or the like. The housing of insulating corrosion-proof material has a cavity containing the contact member. Two openings to the cavity are through an elongated extension around which is positioned a crimping ring. The contact member is a strip of conductive material formed around into a rectangular frame with the two ends overlapping and both adapted to slide by each other. One end, placed in behind the second, contains two wire-receiving openings. The other end has a pair of wire-cutting slots. The wall of the contact member opposite to and paralleling the overlapping ends is bent inwardly to provide a predeformed weakened section.

The two wires to be spliced together are inserted into the two openings in the one end of the contact member through the two openings in the housing. The frame of the contact member is squeezed together or collapsed through the walls of the housing. The two ends slide past one another causing the edges of the slots to slice through the insulation on the wires and to make contact with the conductors therein. Both wires are then electrically bonded together. Concurrently or subsequently the crimping ring is squeezed radially inwardly causing the opening in the extension of the housing to decrease in size so as to provide an environmental seal about the two wires.

DESCRIPTION OF THE PREFERRED EMBODIMENT

Figure 1:
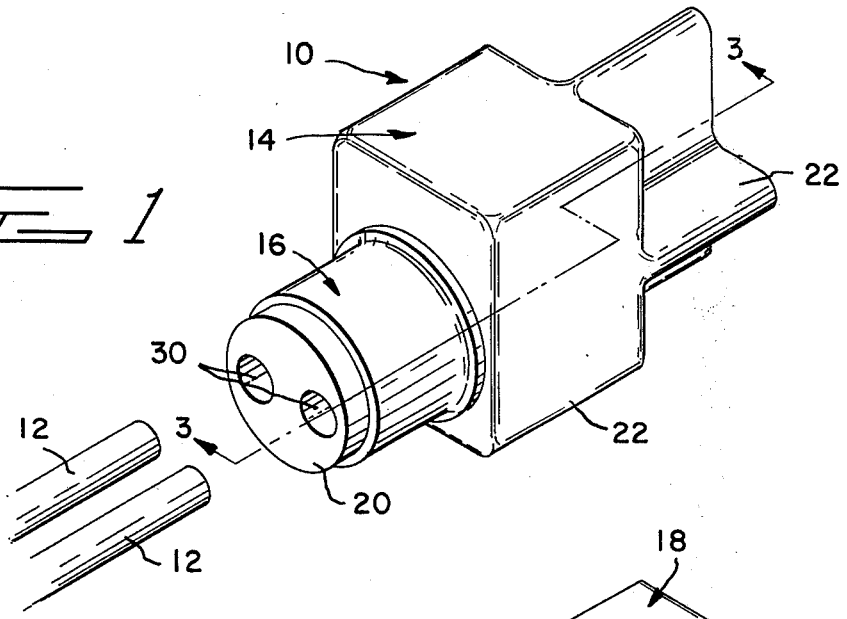
FIG. 1 is a perspective view of the preferred embodiment of the present invention.

FIG. 1 is a drawing showing device 10 ready for use. Two insulation-covered wires 12 which are to be spliced and sealed together within device 10 are shown to the left.

Figure 2:
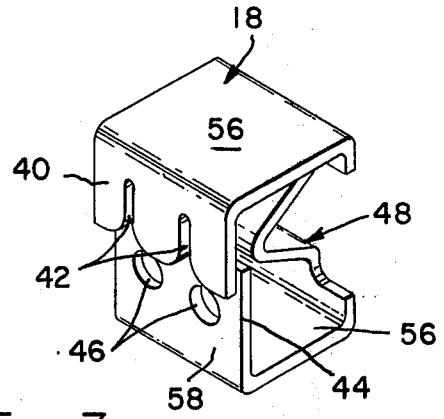
FIG. 2 is a perspective view of the contact member of the preferred embodiment of FIG. 1.

Device 10 consists of a housing 14, crimping ring 16 and contact member 18, the latter shown in FIG. 2.

Figure 3:
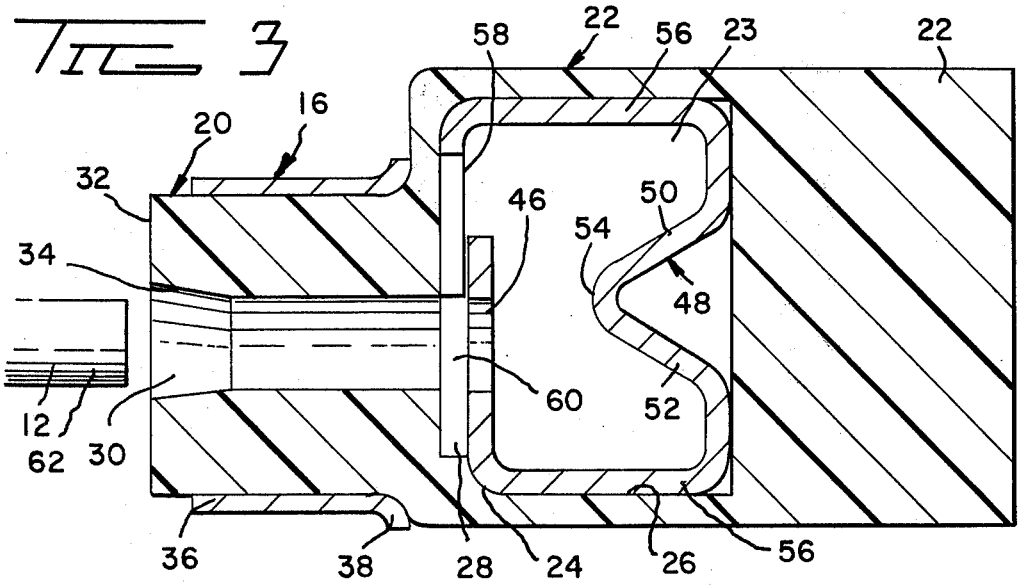
FIG. 3 is an elevational cross-section taken along lines 3—3 of FIG. 1.
Figure 4:
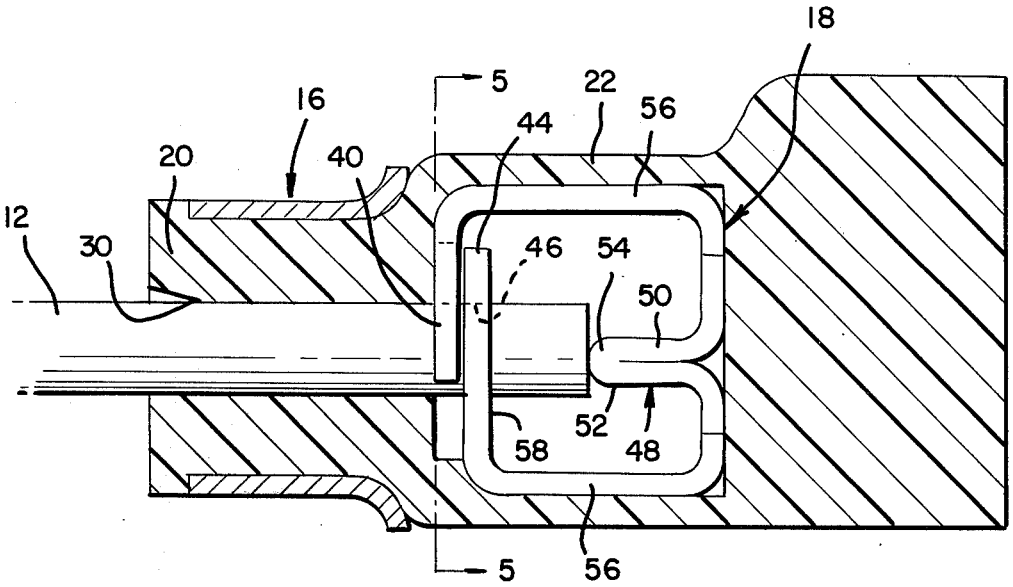
FIG. 4 is an elevational cross-section view showing the preferred embodiment of FIG. 3 after the wires have been spliced therein.

With reference to FIGS. 1 and 3, housing 14 is initially molded into a form having a cylindrical extension 20 and an elongated hollow, rectangularly-shaped section 22 with the back end, i.e., the end opposite the extension, open (not shown). The interior wall surfaces defining a cavity 23 within section 22 are straight except for a step 24 on floor 26 immediately adjacent the forward wall 28.

The cylindrical extension 20 has a pair of parallel passages 30 extending from the front face 32 through the section and opening out on the face of wall 28 into cavity 23. The entrances of the passages may be slightly tapered inwardly as indicated by reference numeral 34.

Housing 14 is preferably made from polyvinyl chloride. Primarily it must be deformable to a certain degree without cracking. Whether it takes a set upon being squeezed is immaterial but preferably it should.

Crimping ring 16 has an elongated crimping section 36 and a bell mouth section 38. The latter is primarily useful for pushing the ring onto extension 20 whose outside diameter is only very slightly smaller than the ring's internal diameter. Ring 16 may be made from tin plated copper, aluminum or other like material which will take a set upon being deformed.

With reference to FIGS. 2 and 3, contact member 18 is stamped and formed from a coplanar strip of conductive material (not shown) such as brass, phosphor bronze or the like. One end 40 has two wire-receiving slots 42. The entrances to the slots may be funnel shaped. The other end 44 has two openings 46. Intermediate the two ends the strip is reduced in breadth to form a fold section 48.

To from the shape shown in FIGS. 2 and 3, the fold section 48 is bent into a wedge or concave shape with two walls 50 and 52 converging to a rounded point 54. The concave shape provides a pre-weakened section. Outwardly from the fold section in both directions the strip is bent ninety degrees to form two short horizontal walls 56. A second set of bends of ninety degrees forms a wall 58 which parallels the fold section and is made up of ends 40 and 44 approaching each other from opposite directions. End 40 is displaced forward of and slightly overlaps end 44. The slots 42 are in general alignment with openings 46.

Device 10 is assembled by inserting the contact member 18 into cavity 23 and closing off the back end 22 by heat sealing. The contact member is placed in the cavity so that its openings 46 are in alignment with passages 30 in extension 20. As shown in FIG. 3, the corner of end 44 abutts step 24 and that a vertical void, indicated by reference numeral 60, is provided between wall 58 and wall 28. As further shown in the figure, preferably the cavity 23 is dimensionally sized to accommodate contact member 18 in a very close fit.

Crimping ring 16 is slipped over extension 20 with the bell mouth section 38 abutting section 22.

FIG. 3 shows an assembled device 10 ready to receive and terminate a pair of wires 12. These wires with their insulation 62 intact are inserted into the contact member openings 46 through passages 30 in the cylindrical extension. As both the passages and opening preferably approximate the wire diameter, the wires are held in position fairly well through interference.

The next step is to drive the slots 42 across the wires so that the slot edges cut through the insulation 62 and make electrical contact with and between the wires conductors 64. This is accomplished by squeezing in on the flat top and bottom surfaces of housing 14 and hence against the short horizontal walls 56 on the contact member. This force causes the two ends 40 and 44 to slide past each other so that the slots receive the wires. Note that end 40 slides into the void indicated by reference numeral 60. The pressure or compressive forces required is lessened by the pre-deformed fold section 48. Obviously this wedge configuration will collapse readily as would other like weakened sections.

Figure 5:
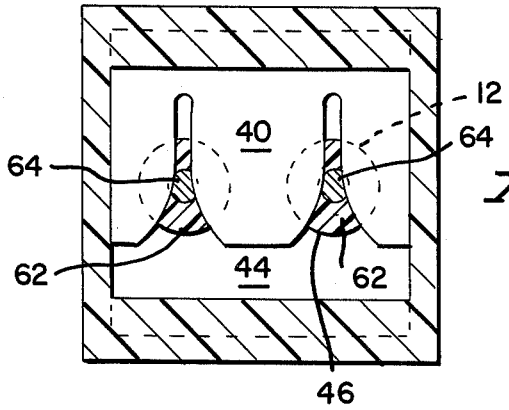
FIG. 5 is an elevational cross-section taken along lines 5-5 of FIG. 4.

FIG. 5 is a cross-sectional view taken looking at the front of contact member 18 so that the cutting action of the edges of slots 42 can be seen.

The final step in the operation is to close passage 30 tightly around wires 12 by radially compressing crimping ring 16 which in turn reduces the passage's diameters.

The foregoing detailed description has been given for clearness of understanding only, and no unnecessary limitations should be understood therefrom, as some modifications will be obvious to those skilled in the art.

What is claimed is:

1. A device for electrically splicing two wires together, which comprises: a strip of conductive material with one end being provided with a pair of parallel wire-receiving slots and the other end being provided with a pair of wire-receiving openings and the strip intermediate the two ends being provided with a pre-weakened section, said strip being formed into a four sided frame with the two ends forming a first side with one end adapted to move past another and the pre-weakened section forming a second side opposing and parallel to the first side so that as the sides of the frame perpendicular to the first and second sides are compressed towards one another one end moves past the other end and a pair of wires which may be positioned in the openings are received in the slots with the edges of the slots making electrical contact therewith and further the pre-weakened section becomes deformed and thereby prevents one end from moving back past the other end so that the wires are retained in the slots.

2. The device of claim 1 further including insulating means for encapsulating said device.

3. The insulating means of claim 2 comprising a cavity section adapted to receive the device and a pair of openings to the cavity section through which the wires to be terminated in the device can be inserted, said insulating means being deformable.

4. The insulating means of claim 3 further including an elongated extension in which the openings are positioned.

5. The insulating means of claim 4 further including crimping means positioned around the extension so that the openings therethrough can be closed around the wires which may be inserted therethrough.

6. A device for electrically splicing two wires together, comprising:

a. a contact member stamped from a strip of conductive material with one end having a pair of wire-receiving slots and the other end having a pair of wire-receiving openings, said strip being formed with one end adapted to be moved past the other so that the edges of the wire-receiving slots can make electrical contact with a pair of wires which may be positioned in the wire-receiving openings and thereby electrically splice the two wires together;

b. a housing of insulating and deformable material containing a cavity in which the contact member is positioned, two of the walls of the housing adapted to be squeezed inwardly against the contact member to move one end thereof past the other end;

c. an extension of the housing having a pair of passages extending therethrough opening into the cavity in alignment with the wire-receiving openings in the contact member, said passages adapted to receive wires therethrough; and d. means on the extension adapted to be radially compressed inward against the extension so that the walls of the passages may be closed in on the wires which may be positioned therein.

7. An insulated device which is adapted to be applied to a wire comprising:

a. a conductive contact member having a first side with a free end and a wire-receiving slot extending into the first side from the free end;

b. wire retaining means positioned in close proximity to the free end for retaining a wire in alignment with the wire-receiving slot so that upon movement of the free end toward and past the retaining means, a wire located thereon will be forced into the slot;

c. said first side and the retaining means being integral with each other by means of a bight portion, said contact member being deformable to permit movement of the free end toward the retaining means;

d. a deformable insulating housing encapsulating said contact member and having an extension projecting beyond the first side and the retaining means, said extension having a wire-receiving opening extending therethrough to permit location of a wire in alignment with the wire-receiving slot whereby, upon insertion of a wire through the opening and compressing the housing in a direction parallel to the wire-receiving slot, said free end will be moved relatively past the retaining means and the wire will be moved into the wire-receiving slot.

* * * * *